United States Patent [19]

Coyle

[11] Patent Number: 4,813,485

[45] Date of Patent: Mar. 21, 1989

[54] GAS AND OIL WELL PUMPING OR SWABBING DEVICE AND METHOD

[75] Inventor: Gary W. Coyle, Caldwell, Ohio

[73] Assignee: ConCoyle Oilfield Tools, Inc., Salt Lake City, Utah

[21] Appl. No.: 60,657

[22] Filed: Jun. 10, 1987

[51] Int. Cl.[4] ..... E21B 43/00

[52] U.S. Cl. ..... 166/372; 166/105; 417/56; 417/58; 417/511; 417/514

[58] Field of Search ..... 166/53, 68, 105, 369, 166/370, 372; 417/56, 58, 510, 511, 514, 520, 555 A

[56] References Cited

U.S. PATENT DOCUMENTS

| | | | |
|---|---|---|---|
| 2,714,855 | 8/1955 | Brown | 417/58 X |
| 2,970,547 | 2/1961 | McMurry . | |
| 3,090,316 | 5/1963 | Montgomery | 166/372 |
| 3,424,093 | 1/1969 | Moore, Jr. | 417/56 |
| 4,070,134 | 1/1978 | Gramling . | |
| 4,528,896 | 7/1985 | Edwards . | |
| 4,629,004 | 12/1986 | Griffin | 166/372 |

OTHER PUBLICATIONS

Ed Walther, Consulting Editor, "AutoSwab Makes Small Wells Profitable", Well Servicing, Nov./Dec. 1986, p. 25.

*Primary Examiner*—Jerome W. Massie
*Assistant Examiner*—William P. Neuder
*Attorney, Agent, or Firm*—Philip A. Mallinckrodt; Robert R. Mallinckrodt

[57] ABSTRACT

The pumping or swabbing device and apparatus of the invention utilizes an elongate barrel slidable upwardly and downwardly on an axial rod which carries a valve element for closing on a valve seat provided interiorly of the barrel to close passage through the barrel of down-hole pressure fluid and cause such fluid to raise barrel and rod of the device through a gas and oil well casing to the wellhead, where liquid above the device is pushed to discharge at the wellhead. Spring actuated detent latching elements coact with a pair of longitudinally spaced lower and upper latching recesses to hold the barrel and rod together against relative movement in lower valve-closed and upper valve-opened positions. A sealing packer encircles the barrel and a by-pass passage thereinto leading from and back into the barrel flow passage provides sealing pressure within such packer as the device rises in the well casing. A manually or pressure operated latch provides for holding the device in the wellhead as desired.

15 Claims, 1 Drawing Sheet

GAS AND OIL WELL PUMPING OR SWABBING DEVICE AND METHOD

BACKGROUND OF THE INVENTION

1. Field

The invention is in the field of apparatus that utilizes downhole fluid pressure in gas and oil wells to lift oil or other liquids to the surface in place of pumping.

2. State of the Art

So-called "rabbits" or "plunger lifts" are customarily employed in the relatively small diameter strings of tubing normally placed in relatively large diameter well casings for production purposes. These lifts are in the form of piston-like bodies that descend through any liquid in the tubing by free fall under the influence of gravity and that push such liquid upwardly when downhole gas pressure raises the piston in such tubing. U.S. Pat. No. 2,970,547 of Feb. 7, 1961 to E. D. McMurray shows such a lift. More recently, a gas-powered swabbing device has been developed to somewhat similarly raise oil or other liquids within the well casing itself under the control of differential pressures within such well casing, see U.S. Pat. No. 4,070,134 issued Jan. 24, 1978 to William Dwight Gramling.

SUMMARY OF THE INVENTION

Difficulties have been encountered in using apparatus of the type concerned for lifting oil and other liquids through the well casing itself by means of differential gas pressure control. In accordance with the invention, a positive system of mechanical control that enables the lifting of exceptionally long columns of liquid repeatedly over long periods of operation without difficulty has been developed.

The invention utilizes an elongate valve-actuating rod that extends from end-to-end, and beyond such ends, of an elongate barrel which is capped at both ends and provided internally with a valve seat intermediate its length and with lower and upper ports interconnected by the interior of the barrel as a flow passage (and preferably by a by-pass passage into and out of a sealing packer), with the valve seat being positioned therebetween. The valve-actuating rod carries a valve element below the valve seat and detent latching means spaced along the rod for holding such rod in either a valve closed position preventing fluid flow through the flow passage, or a valve open position which allows free flow of fluid between the upper and lower ports. In order to achieve the valve closed position, the valve-actuating rod abuts a tripping device positioned near the bottom of the well, but above the normal perforations, and the barrel continues to descend and brings the valve seat in contact with the valve element. In similar fashion, the valve open position is achieved when the valve actuating rod is stopped as it abuts a cap at the wellhead and the barrel continues to ascend.

Although the aforementioned McMurray patent utilizes a reciprocating rod, which is generally similar to applicant's valve-actuating rod, not only is the McMurray device limited in its application to production tubing within a well casing, but it requires a motor valve for effective operation. Moreover, there is no provision for positively holding the reciprocating rod in one or the other of its terminal positions. Also, it does not provide a seal between the device and the interior surface of the pipe within which it operates.

THE DRAWING

The illustrated embodiment of apparatus represents the best mode presently contemplated for carrying out the invention in actual practice.

In the drawing:

FIG. 1 is a fragmentary, vertical, axial section through the apparatus as installed in a gas and oil well, being shown in its detent-held, valve-open position and poised for gravity descent through the well casing to a position near its bottom for a renewed lift stroke;

FIG. 2, a somewhat similar view of the apparatus in its bottom hole position within the well casing, with the valve of the apparatus being in its detent-held, valve-closed position in preparation for raising, along with any liquid above it in the well casing, to the position in FIG. 1 by reason of bottom hole gas pressure, an intermediate portion being broken out for convenience of illustration;

FIG. 3, a view in horizontal section taken along the line 3—3 of FIG. 1 and drawn to a larger scale; and FIG. 4, a similar view taken along the line 4—4 of FIG. 1.

DETAILED DESCRIPTION OF THE ILLUSTRATED EMBODIMENT

Figure 1:
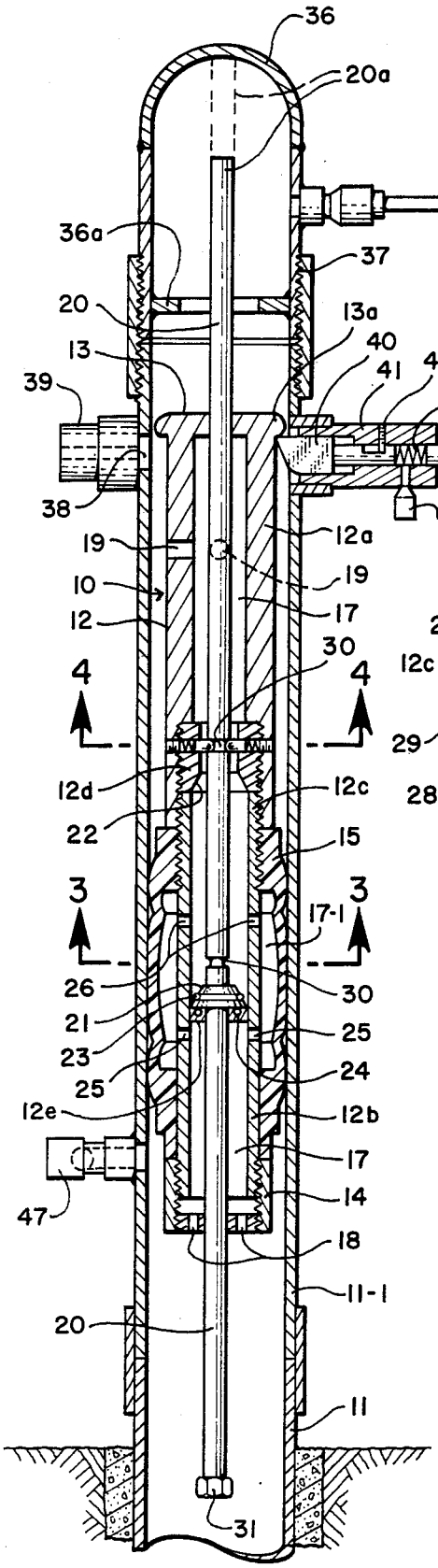
Figure 4:
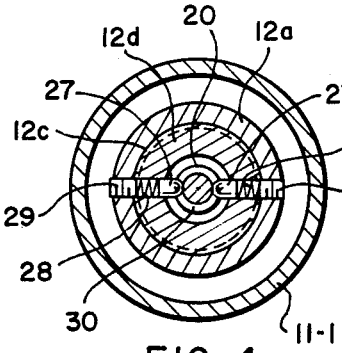
Figure 3:
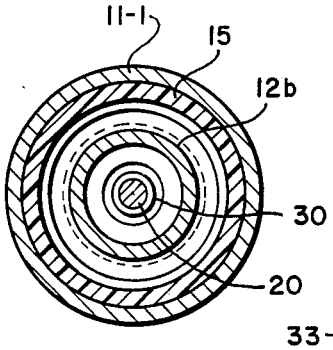

As shown, the apparatus of the invention comprises a well pumping or swabbing device 10 slidably mounted in well casing 11 for up and down reciprocation therein and into wellhead casing 11-1. Such device 10 comprises an elongate barrel 12 made up of a thick-walled cylindrical section **12*a* and a relatively thin-walled cylindrical section 12*b* threadedly joined as at 12*c*. Barrel 12 has a cap 13 at its upper end with an overhanging rim 13*a*, and a screw-on cap 14, at its lower end. A well-casing-sealing packer 15 is connected at its upper end to the upper end of barrel section 12*b*, as by screw threads. Its lower end freely encircles barrel section 12*b***.

The open interior of barrel 12 provides an elongate flow channel 17 for liquid within well casing 11 as the pumping or swabbing device descends in such well casing under the influence of gravity. Liquid enters barrel 12 by way of inlet ports 18 in cap 14. Such inlet ports may be of any suitable number and arranged in any suitable manner, for example, as is illustrated. The entering liquid discharges from barrel 12 back into well casing 11 through outlet ports 19 near the upper end of the barrel during descent of the barrel within the well casing, and the rapidity of such descent may be controlled by properly sizing outlet ports 19 relative to inlet ports 18, i.e. by making the size or number of outlet ports 19 suitably less than that of inlet ports 18.

Extending through the open interior of barrel 12 and beyond at both ends thereof, passing slidably through the opposite end caps 13 and 14, is a valve-actuating rod 20 fixedly carrying near its lower end a valve element 21 adapted to mate with a valve seat 22 that is advantageously formed upwardly thereof by a barrel insert **12*d*. Inlet ports 18 are located below the valve seat. An O-ring 23 is desirably interposed in the seating face of valve element 21 and another, 24, on the upper face of a partition member 12*e*, which advantageously directs upward flow in barrel flow passage 17 outwardly through ports 25 into a by-pass 17-1 through the interior of packer 15, from where it flows back into passage 17 through ports 26**.

A feature of the invention is the provision of detent latching means for automatically and positively latching valve-actuating rod 20 alternately in its valve open and its valve closed positions. As here shown, such means advantageously comprise diametrically opposed latch elements 27, which may be plungers with semi-spherical latching ends, urged inwardly of barrel 12 toward rod 20 by respective springs 28 held in accommodating passages in barrel 12 and barrel insert **12*d* by respective set screws 29. Such detent latching means also comprise upper and lower latch-element-receiving, circumferential grooves 30, respectively, in rod 20, the placement of such grooves corresponding with the valve open and valve closed positions of rod 20, respectively, within barrel 12 on the reciprocative strokes of such rod. A nut 31 is desirably screwed onto the lower end of rod 20**, as shown, for abutment purposes.

Valve-actuating rod 20 is tripped to close valve element 21 at the lower termination of each downstroke of device 10 by abutment of its lower end and of nut 31 against a stand 32 that is usually placed at the bottom of the well on a length of tubing 33, carrying a conventional centralizer 34, so the stand is above the level of the usual casing perforations 35 that tap the producing zone of the formation. Barrel 12 continues to descend about rod 20 until valve element 21 is forced tightly against valve seat 22, at which position the latching ends of detent latch elements 27 are firmly positioned within the lower groove 30. When pressure builds up below packer 15 significantly to raise the entire device 10 and liquids that are above it in the well casing, such device and liquids will move upwardly in the well casing 11 and into the wellhead casing 11-1.

As indicated in FIG. 1 by dotted lines, the upper end **20*a* of rod 20 will abut the underside of a wellhead cap 36, which is secured over the upper open end of wellhead casing 11-1 by means of a sleeve 37, and barrel 12 will continue upwardly relative to the rod until its cap 13 abuts a ring stop 36*a*, FIG. 1, projecting inwardly of wellhead cap 36 near the lower end thereof. This prevents over-travel of barrel 12** relative to the rod.

Figure 2:
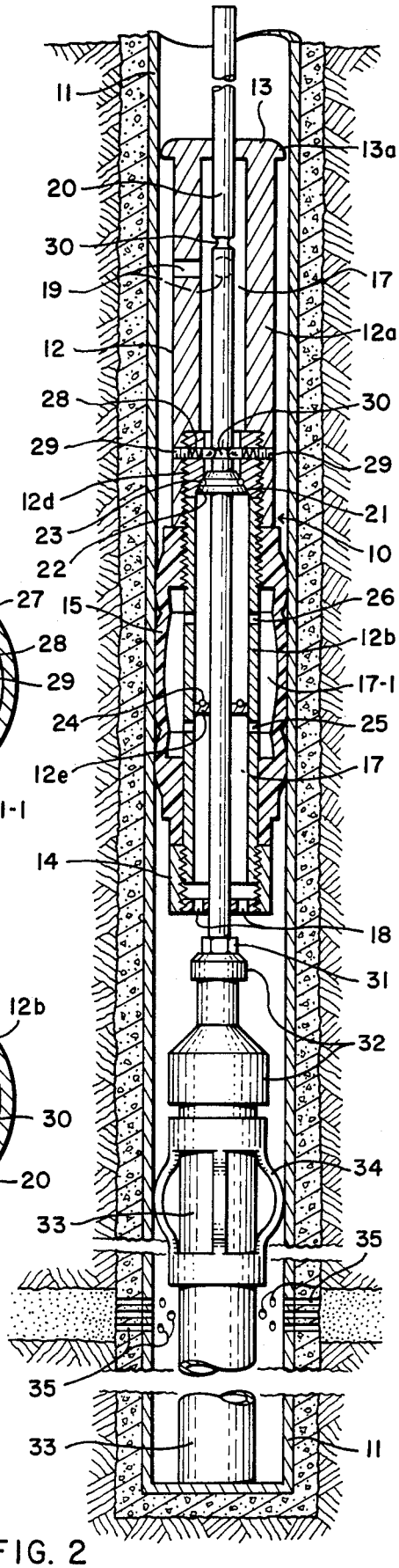

When barrel 12 moves upwardly relative to rod 20 from the valve closed position shown in FIG. 2 after the upper end **20*a* of the rod abuts the underside of cap 36, valve seat 22 leaves valve element 21 to open the valve and detent latch elements 27 are pushed out of the lower latching groove 30 of rod 20 and automatically latch into the upper latching groove 30, as shown in FIG. 1. Previously thereto, liquid lifted by device 10 had flowed out of the well casing through transverse passage 38 and a safety choke 39** of conventional construction to a holding tank, for example.

With the valve open, device 10 falls all the way back down the well casing, unless caught by a latch element 40 that is positioned in a transverse tubular appendage 41 to catch under overhanging rim **13*a* of barrel cap 13 when thrown to latching position. If barrel 12 is caught, the device remains in wellhead 11-1 with valve open until latch element 40** is withdrawn.

It should be noted that in such caught and held position, valve 21, 22 is open with valve element 21 resting against partition **12*e***.

Latch element 40 is operated by valves 42 and 43, respectively, which valves may be constructed for manual operation or may be time-activated or pressure-activated motor valves of conventional construction. When thrown toward well casing 11 by the action of spring 44, the tip of latch element 40 catches under overhanging rim **13*a* of cap 13 of barrel 12 to prevent descent of device 10. Inward travel of latch element 40 is limited by set screw 45**.

When valve 42 is closed and 43 open, gas pressure through pipe 46 is equalized on both ends of latch element 40 and spring 44 urges the latch element into its latching position with respect to cap 13 of barrel 12. With valve 43 closed and valve 42 open, wellhead pressure overcomes the urging of spring 44 and latch element 40 is withdrawn from well casing 11 to permit descent of device 10.

A usual blow-off valve 47 is provided in wellhead casing 11-1 to blow-off pressure in the wellhead should valve 21, 22 malfunction. Such blow-off valve 47 serves a dual function here, since it enables passage of a probe therethrough when such valve 47 is open for determining at any time whether the device is in the wellhead.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. An elongate gas and oil well pumping or swabbing device for insertion lengthwise within a well casing having a wellhead casing closed by a wellhead cap, comprising an elongate barrel capped at its bottom and top ends and having an open interior defining an elongate flow passage valve means including a valve seat defined internally of said barrel and extending across said flow passage; lower port means extending through said barrel into direct communication with said flow passage below said valve seat to provide flow communication between the outside and the open interior of said barrel; upper port means, of lesser flow capacity than the lower port means, extending through said barrel above said valve seat to provide relatively restricted flow communication between the open interior of said barrel and the outside thereof; an elongate actuating rod within and extending through the open interior of said barrel, the capped ends of the barrel being apertured and slidably receiving respective opposite ends of said rod; a valve element included as part of said valve means and fixedly carried by said rod below said valve seat for movement with said rod upwardly and downwardly and for alternately closing and opening said flow passage by reason of relative movement between rod and barrel; cooperative detent latching means on said rod and in said barrel, respectively, and having a lower latching position and having an upper latching position; wellhead latching means comprising latch means fixedly carried by said barrel exteriorly thereof and adapted for cooperation with cooperative latch means carried by the wellhead for holding the device in a raised position at the wellhead; a flexible and resilient sleeve encircling said barrel externally thereof; and ports through the side walls of said barrel opening into the interior of said sleeve adjacent to the lower and upper ends thereof, whereby inflow of fluid into said sleeve from said barrel during both descent and ascent of the device in the well casing will cause said sleeve to expand and bear against the wall of said well casing during both said descent and said ascent.

2. A device according to claim 1, wherein the barrel has a closed upper end with overhanging rim.

3. A device according to claim 1, wherein the barrel comprises a longitudinal upper section and a longitudinal lower section joined together approximately midway of the length of said barrel.

4. A device according to claim 1, wherein partition means is provided in and across the interior of the barrel between the inflow and outflow ports leading into and out of the sleeve.

5. A device according to claim 1, wherein the cooperative detent means comprise a set of resiliently biased detent elements carried by the barrel and normally urged interiorly thereof circumferentially of the rod; and a pair of lower and upper circumferential grooves on the rod in mutually spaced relationship along its length for alternately receiving said detent elements as the device descends and rises in the well casing.

6. A device according to claim 1, wherein the lower latching position of the detent latching means is tightly correlated with the respective positions of the valve seat in the barrel and the valve element on the rod so that the valve is closed in the lower latching position of the detent latching means.

7. In combination with a gas and oil well provided with a well casing and a wellhead, pumping or swabbing apparatus comprising a pumping or swabbing device within said well casing and adapted for being raised along with any liquid above it in the well casing by downhole pressure bearing against its lower end and for being lowered through any liquid in the well casing under the force of gravity, said pumping or swabbing device comprising an elongate barrel capped at its bottom and top ends and having an open interior defining an elongate flow passage; valve means including a valve seat defined internally of said barrel and extending across said flow passage near the lower end thereof; lower port means extending through said barrel into direct communication with said flow passage below said valve seat to provide flow communication between the outside and the open interior of said barrel; upper port means, of lesser flow capacity than the bottom port means, extending through said barrel above said valve seat to provide relatively restricted flow communication between the outside and the open interior of said barrel; an elongate actuating rod within and extending through the open interior of said barrel, the capped ends of the barrel being apertured and slidably receiving respective opposite ends of said rod; a valve element included by said valve means and carried by said rod below said valve seat for reciprocal movement with said rod and for alternately closing and opening said flow passage upon reciprocation of said rod within said barrel; cooperative detent means on said rod and in said barrel, respectively, for automatically holding said rod in an upper position with said valve closed or in a lower position with said valve open; abutment means for said rod near the bottom of the well within said well casing; a flexible and resilient sleeve encircling said barrel externally thereof in sealing relationship with and against the walls of said well casing to confine downhole pressure as the device descends and rises in the well casing; and ports through the side walls of said barrel opening into the interior of said sleeve adjacent to the lower and upper ends thereof, whereby inflow of fluid into said sleeve from said barrel during both descent and ascent of the device in the well casing will cause said sleeve to expand and bear against the wall of said well casing during both said descent and said ascent; abutment means for said rod in said wellhead; gas and oil take-off means in said wellhead; latch means carried by said well casing adjacent its upper end for latching cooperation with latch keeper means; and latch keeper means exteriorly of said barrel for latching said pumping or swabbing device in an upper position within said well casing.

8. A device according to claim 7, wherein stop means is provided internally of the wellhead for engagement by the upper end of the barrel to prevent overtravel of the barrel relative to the rod.

9. Apparatus in accordance with claim 7, wherein a transverse substantially horizontal passage is provided through the wellhead, supplying a connection with a gas and oil offtake pipe and a mounting for a latch cam; and a latch cam operably mounted in said wellhead passage.

10. Apparatus in accordance with claim 7, wherein a blow-off valve is provided in the wellhead casing to serve the dual purpose of relieving excess pressure in the well and of admitting a probe for determining whether the device is in the wellhead casing at any given time.

11. An elongate gas and oil well pumping or swabbing device for insertion lengthwise within a well casing having a wellhead casing closed by a wellhead cap, comprising an elongate barrel capped at its bottom and top ends and having an open interior defining an elongate flow passage; valve means including a valve seat defined internally of said barrel and extending across said flow passage; lower port means extending through said barrel into direct communication with said flow passage below said valve seat to provide flow communication between the outside and the open interior of said barrel; upper port means, of lesser flow capacity than the bottom port means, extending through said barrel above said valve seat to provide relatively restricted flow communication between the open interior of said barrel and the outside thereof; an elongate actuating rod within and extending through the open interior of said barrel, the capped ends of the barrel being apertured and slidably receiving respective opposite ends of said rod; a valve element included as part of said valve means and fixedly carried by said rod below said valve seat for movement with said rod upwardly and downwardly and for alternately closing and opening said flow passage by reason of relative movement between rod and barrel; cooperative detent latching means on said rod and in said barrel, respectively, having a lower latching position that is assumed following descent of the device with said valve means open for automatically holding the barrel in a lower position with the valve means closed, and having an upper latching position that is assumed following upward travel of the device with said valve means closed for holding the barrel in an upper position with the valve means open, said lower latching position being coordinated with the position of said rod when its lower end abuts abutment means maintained near the bottom of the well casing so said barrel will descend relative to the rod until the valve means closes and the barrel is latched to the rod by said detent means in the lower position thereof, the device being then forced by downhole pressure to rise within the well casing; wellhead latching means comprising latch means fixedly carried by said barrel exteriorly thereof and adapted for cooperation with cooperative latch means carried by the wellhead for holding the device in a raised position at the wellhead, said upper latching position being coordinated with the position of said rod following abutment of its upper end against abutment means adjacent to the wellhead, whereby continued upward movement of said barrel relative to said rod will unseat said valve element and will continue until said detent means latches in its upper latching position, at which time the entire device will descend to wellhead latching position and beyond if not latched into said wellhead latching position; a flexible and resilient sleeve encircling said barrel externally thereof; and ports through the side walls of said barrel opening into the interior of said sleeve adjacent to the lower and upper ends thereof, whereby inflow of fluid into said sleeve from said barrel during both descent and ascent of the device in the well casing will cause said sleeve to expand and bear against the wall of said well casing during both said descent and said ascent.

12. A method of pumping a gas and oil well having a well casing and a wellhead casing, comprising inserting into the well casing and the wellhead casing of the well a device in accordance with claim 1 with its internal valve latched into open position so the device drops to the bottom of the well; placing said valve into closed position at the bottom of the well and latching it into said closed position; allowing gas pressure in the well below said closed valve to lift the device and liquid above it in the well into the wellhead casing; flowing off said liquid from the wellhead casing; placing said valve into latched open position within the wellhead casing; and repeating the procedure indefinitely.

13. A method according to claim 12, including the step of directing fluid into the sleeve as the device rises and descends in the well casing.

14. A method according to claim 13, including the step of latching the device in the wellhead casing for a period of time prior to repeating the procedure in any given instance.

15. A method according to claim 13, wherein there is a blow-off valve in the wellhead casing; and the method includes the step of inserting a probe through said blow-off valve at any given time to determine whether the device is in the wellhead casing.

* * * * *

UNITED STATES PATENT AND TRADEMARK OFFICE

CERTIFICATE OF CORRECTION

PATENT NO. : 4,813,485

DATED : March 21, 1989

INVENTOR(S) : Gary W. Coyle

It is certified that error appears in the above-identified patent and that said Letters Patent is hereby corrected as shown below:

Column 4, line 32, after "passage" insert a semi-colon.

Column 5, line 18, delete "tightly"; line 21, after "is" insert --tightly--.

Column 8, lines 11 and 15, change "13" to --12--.

Signed and Sealed this

Twenty-sixth Day of September, 1989

*Attest:*

DONALD J. QUIGG

*Attesting Officer*

*Commissioner of Patents and Trademarks*